United States Patent [19]

Garthe

[11] Patent Number: 4,767,115

[45] Date of Patent: Aug. 30, 1988

[54] ADJUSTABLE ACCUMULATOR FOR PAPER SHEETS

[75] Inventor: Matthias Garthe, Friedberg, Fed. Rep. of Germany

[73] Assignee: Bell & Howell GmbH, Friedberg, Fed. Rep. of Germany

[21] Appl. No.: 26,721

[22] PCT Filed: Jul. 14, 1986

[86] PCT No.: PCT/EP86/00414

§ 371 Date: May 13, 1987

§ 102(e) Date: May 13, 1987

[87] PCT Pub. No.: WO87/00514

PCT Pub. Date: Jan. 29, 1987

[30] Foreign Application Priority Data

Jul. 13, 1985 [DE] Fed. Rep. of Germany ..... 3525057
Apr. 30, 1986 [DE] Fed. Rep. of Germany ..... 3614694

[51] Int. Cl.[4] ..... B65H 31/20
[52] U.S. Cl. ..... 271/223; 271/171
[58] Field of Search ..... 271/223, 224, 171, 144

[56] References Cited

U.S. PATENT DOCUMENTS 2,785,893 3/1957 Ford ..... 271/223 X
4,097,042 6/1978 Rozga ..... 271/171

*Primary Examiner*—Richard A. Schacher

[57] ABSTRACT

Disclosed is an accumulator for paper sheets which are conveyed by conveyor belts to a receiving area comprised of parallel support members having spaces therebetween. The conveyor belts are mounted on rollers, at least one set of which is mounted on a first track-mounted movable carriage, and at least one other set of which is mounted on a second track-mounted movable carriage. The two carriages are linked so that motion of said first carriage to adjust the length of the receiving areas causes motion of said second carriage in a direction opposite to the motion of said first carriage to thereby maintain the conveyor belts under constant tension. The support members may be constituted of either plastic or metallic strips or rods. At least one set of rollers also has bristle means to aid in the conveyance of the paper sheets.

15 Claims, 3 Drawing Sheets

ADJUSTABLE ACCUMULATOR FOR PAPER SHEETS

FIELD OF THE INVENTION

This invention relates to an accumulator for accumulating paper sheets; more particularly the invention relates to an accumulator which can be adjusted to accommodate a set of sheets having a variable format.

BACKGROUND AND OBJECTS OF THE INVENTION

In accumulators of the prior art an adjustment of the area in which the paper sheets are received to accommodate variable formats is possible only within relatively narrow limits and such adjustment requires complicated means. Furthermore, a reliable, trouble-free operation is not insured to the same degree throughout the range of different paper formats to which the accumulator can be adjusted. In addition, the area in which the paper sheets is received is constituted in accumulators of the prior art by a closed bottom of sheet metal, which sometimes exerts a suction effect on the paper sheet that has been received first so that the paper sheet may not be uniformly fed to the receiving area. Furthermore, the closed bottom of the trough which is provided in the receiving area promotes the build-up of an electrostatic charge which renders the feeding of the paper sheet more difficult. Moreover, in the known accumulators of the prior art in which the receiving area is constituted by a closed bottom, those parts of the equipment which are disposed beneath the bottom are accessible only with difficulty for repair and service work.

Accordingly, it is a primary object of the invention to provide an accumulator which (a) allows access to those parts of the equipment which are disposed beneath the receiving area of the accumulator, (b) avoids both a suction and an electrostatic attraction between the receiving surface of the accumulator and the paper sheet to be conveyed, and (c) permits the surface of the receiving area to be adjusted in a simple manner in a direction parallel to the direction of travel of the paper to accommodate a variable paper format.

SUMMARY OF THE INVENTION

In accordance with the invention, the above objects are achieved by mounting rollers, which support the upper course, or surface, of the conveying belt in a movable carriage, movable in a direction parallel to the direction of conveyance of the paper. The belt loop comprising said upper course, or surface, can thereby be increased or decreased in length, while the conveyor belt extending from the belt loop is trained around deflecting rollers and is guided to a length-compensating loop, where it is tensioned by a compensating roller. The compensating roller is itself mounted on a movable carriage and the arrangement is such that an increase or decrease of the length of the belt loop engaging the paper to be fed will result in a corresponding increase or decrease of the length-compensating loop. Movement of the first carriage to alter the upper course, or surface, of the conveyor belt conveying the paper alters the longitudinal extent of the receiving surface and thus allows the adjustment of the receiving surface to the desired paper format. Furthermore, those parts of the conveying means which are disposed in the plane of the receiving surface are of a particularly efficient structure so that components located therebeneath are readily accessible and can easily be serviced.

The two carriages which support the rollers both to guide the conveyor loop, of which there is at least one, and the length compensating loop, are guided by horizontal tracks provided in the housing of the apparatus and the movement of the two carriages is synchronized by means of wire rope loops, toothed belt loops, or the like. These loops of wire rope, or toothed belt, are trained around rollers affixed to the housing and the rollers functioning to guide the conveyor belt in the length-compensating portion thereof are mounted to the additional carriage by means of a spring-biased mounting so that the conveyor belt, or belts, will always be held taut.

In accordance with one embodiment of the accumulator, the supporting means of the receiving area are comprised by a row of thin, flexible, tensile strips, which extend in a horizontal plane parallel to the other and to the direction of conveyance. These strips may be either metal wires or plastic strings, or thin wire ropes, or the like. By thus constituting the supporting means of the receiving area without a closed bottom of sheet metal, the accumulation, and subsequent conveyance, of the paper sheet or sheets is not adversely affected by a suction effect, or by an electrostatic charge, while at the same time, greatly simplifying access to components located beneath the receiving area for service and/or repair.

BRIEF DESCRIPTION OF THE DRAWINGS

The foregoing and other objects, features and advantages of the invention will be apparent from the following more particular description of several exemplary embodiments of the invention, as illustrated in the accompanying drawings.

DETAILED DESCRIPTION OF THE INVENTION

Figure 1:
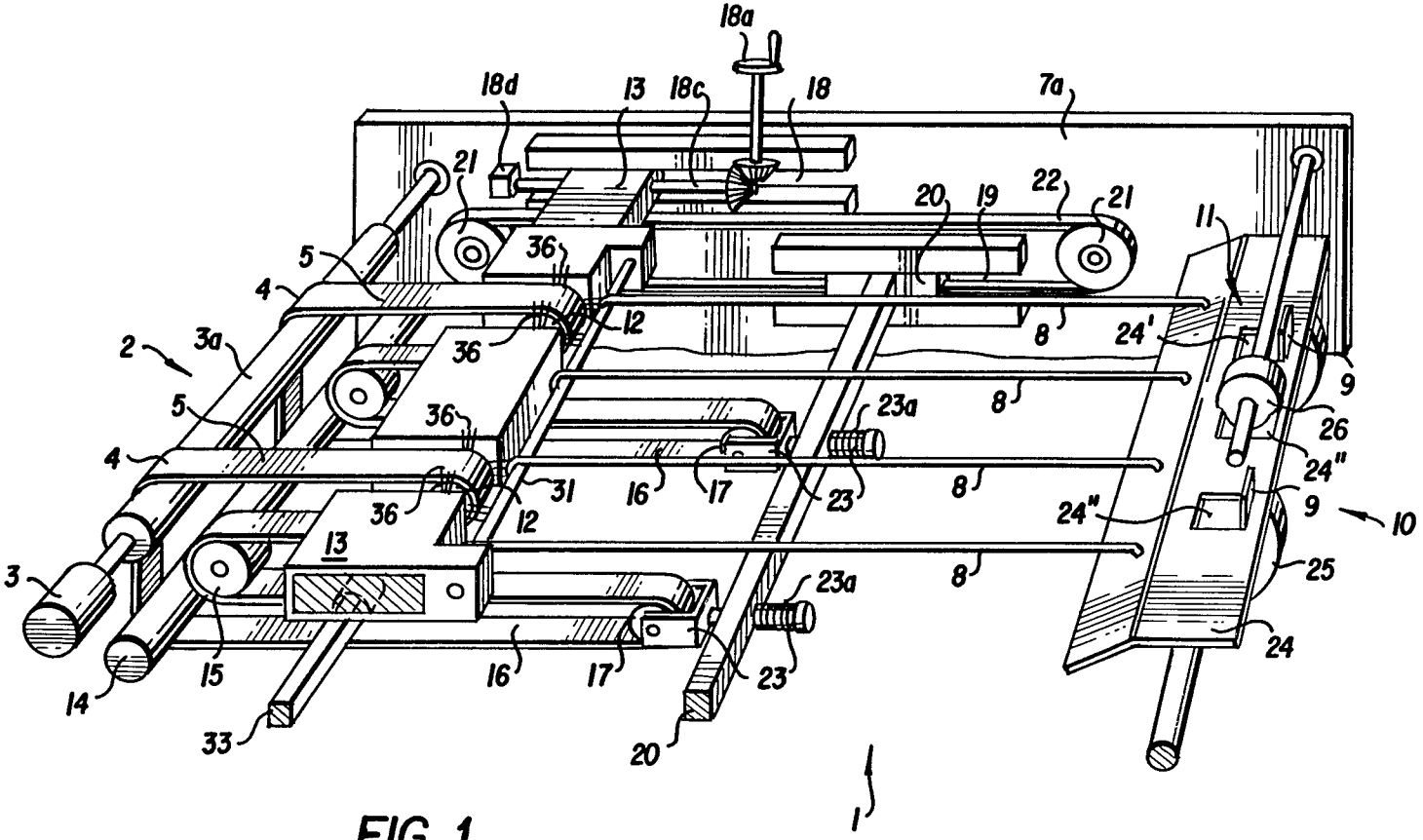
FIG. 1 is a partial perspective view showing an accumulator comprising two parallel conveyor belts, according to the invention. A pressure-applying belt lying on the upper course of each of the conveyor belts has been omitted, as well as portions of the housing facing the viewer, so that the principles of the invention may be more easily illustrated.
Figure 2:
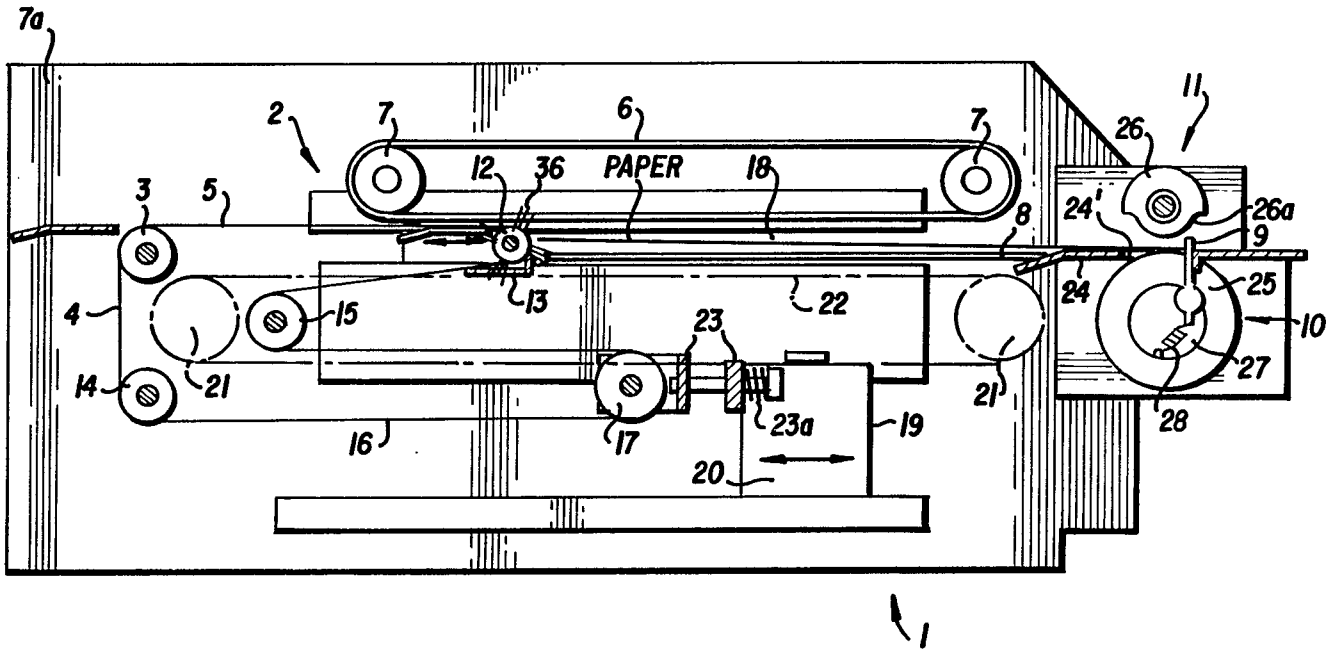
FIG. 2 is a side elevation showing an accumulator according to the invention, similar to that shown in FIG. 1 but with certain parts, not shown in FIG. 1, included.

Referring now to FIGS. 1 and 2, an accumulator generally designated 1 receives paper sheets from another feeder (not shown) from a direction 2. The paper sheets are thereafter accumulated in the accumulator 1 to form a set. The feeder means (not shown) may consist of a cutter, which serves to sever individual paper sheets from an endless form, or a dispensing device of another accumulator which precedes the present accumulator 1. In any case, the feeder (not shown) delivers paper sheets between the upper course, or surface, 5 of each of two separate, parallel conveyor belts 4 and a pressure-applying belt means 6 (FIG. 2) the latter being trained around rollers 7. As is well known in the art, rollers 7 are mounted in a separate frame which is pivoted to the housing *7a* and which is biased by spring means (not shown) in such a manner that the pressure-applying belts 6 are held in engagement with the upper courses, or surfaces 5 of the conveyor belts 4.

In FIG. 1, the pressure-applying belt means have been omitted so as to make more visible those parts of the accumulator which are disposed therebeneath to more clearly illustrate the principles of the invention.

From an elongated roller *3a*, common to both conveyor belts 4 and driven by a drive means 3, the upper course, or surface 5 of each conveyor belt 4 extends to guide rollers 12 which are rotatably mounted on a carriage 13. The carriage 13 extends over the width of the accumulator transversely to the direction of conveyance of the paper sheets. As is apparent from FIG. 1, the carriage 13 consists of a beam which has recesses through which the conveyor belts 4 may extend. The level of the upper surfaces 5 of each conveyor belt 4 is slightly higher than the top of the carriage 13.

The carriage 13 is mounted in laterally disposed horizontal slide tracks 18 (of which only one is shown) so that the carriage 13 and the rollers 12 are displaceable in, or opposite to, the direction of conveyance of the conveyor belt 4. The slide tracks 18 are secured to the two sidewalls (one of which is not shown) of the housing *7a* of the accumulator. The housing wall which is closer to the viewer of FIG. 1 carries a slide track 18 for the carriage 13 similar to the one that is illustrated. The shifting means, for displacing carriage 13 in the direction of conveyance, or opposite thereto, comprises a rotatable wheel 18*a*, coupled by way of a bevel gear arrangement 18*b*, to rotate a screw 18*c* passing through the carriage 13 and threaded thereto. At the distal end of screw 18*c* a nut 18*d* (fixed to the housing *7a*) serves to act as a stop for receiving the threaded screw 18*c*. Rotation of the wheel 18*a* will cause a displacement of the carriage 13 in track 18 and will change the length of the belt loop of which the upper surface 5 of the belt 4 forms a part. To compensate for that change in length of the upper belt loop, each belt 4 is trained around deflecting rollers 14 and 15 to form a length-compensating loop 16. The length compensating loop 16 is supported at its downstream end in the direction of conveyance by compensating rollers 17. The compensating rollers 17 are, in turn, mounted on U-shaped members 23 which are mounted on a further carriage 20. The U-shaped members 23 are displaceable relative to carriage 20 to a small extent by virtue of the springs 23*a* being capable of absorbing a portion of lost motion and possible lengthening of the belts.

As carriage 13, the carriage 20 is guided in a further track 19 (of which only one is shown) for a horizontal displacement in the direction of conveyance of the belt 4. The further track 19 is mounted on the sidewalls *7a* (only one of which is shown) of the housing.

A synchronization of movement of the carriages 13 and 20 is assured by wire rope loops 22, which are trained around rollers 21 (only one of which is shown). Rollers 21 are rotatably mounted in the housing walls *7a*. It will be understood by a person skilled in the art that wire rope loops corresponding to the wire rope loop 22 shown in FIGS. 1 and 2 are provided on both sidewalls of the housing and at least one pair of rollers 21 disposed on opposite sides of the receiving area of the accumulator can be coupled by a shaft (not shown) in order to insure a straight-line movement of the carriages 13 and 20, as the carriage 13 is adjustably moved in a direction parallel to the conveyance of the paper sheets previously discussed.

When the carriage 13 is displaced by the shifting means 18*a*–18*d* shown in FIG. 1 in order to increase the length of the upper surface 5 of each belt 4, the length-compensating loop 16 will be shortened to a corresponding extent by a displacement of the carriage 20 opposite to the direction of travel of the upper course 5 of the belts 4 so that the latter are kept taut because mounting means 23 provided on the carriage 20 are capable of a lost motion against the force of springs 23*a*.

Figure 3:
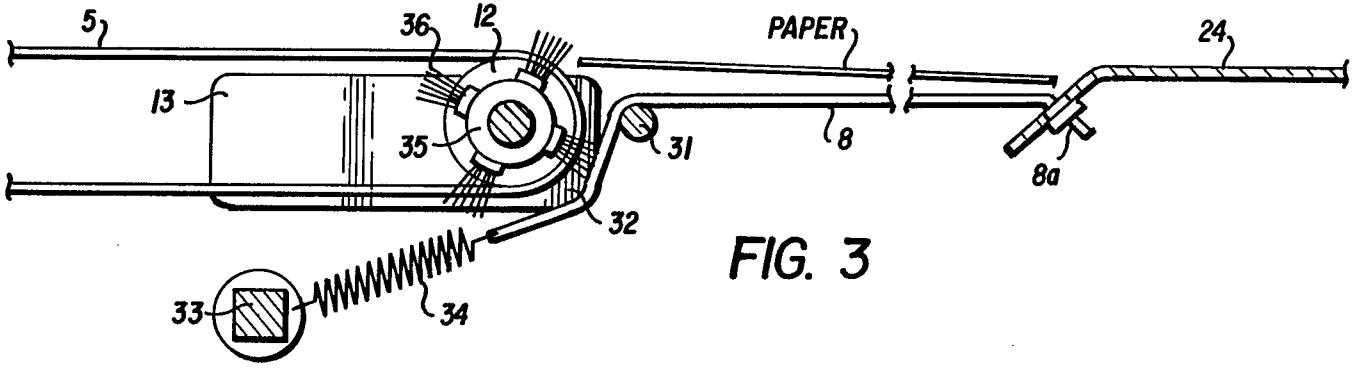
FIG. 3 is a fragmentary elevation showing part of the carriage supporting the rollers for guiding the conveyor belts and also shows an embodiment of the supporting means of the receiving area comprising stretched thin tensile strips.

Disposed below the plane of the upper surface 5 of the belts 4, the accumulator comprises means 8 fcr supporting the paper sheets. The supporting means 8 comprise a row of parallel plastic strings under tension fastened to an end bar 24 by fastening means 8*a*. The strip 8 extend from the end bar 24, over a deflecting, or guide, rod 31 affixed to the carriage 13. Each plastic string 8, as is further shown in FIG. 3, is thereafter guided beneath the lower edge 32 of the carriage 13 and then, via interposed tension springs 34 to an anchor rod 33 secured to the housing *7a*. As a result of this design of the supporting means 8, the carriage 13 is movable, back and forth, in the direction of the conveyance of the paper without a change in the geometry (i.e. the relationship between the strips 8 and the carriage 13) in the receiving area immediately behind the carriage 13.

Referring now, again, to FIGS. 1 and 2, the trailing end of the receiving area in the direction of conveyance is comprised by a stop device generally indicated by the numeral 10 and a delivery means generally indicated by the numeral 11. The backing end of the receiving area is defined by stops 9 which protrude through apertures 24' of the end bar 24. The stops 9 are pivotably and eccentrically, mounted on rotating actuating discs 27 and are held thereon by means of springs 28. Rotating discs are directly coupled to a conveyor roller 25 and as the actuating discs 27 rotate, the stops 9 are moved against the edge of the apertures 24' and caused to descend out of the path for the paper sheets to be removed from the accumulator. Subsequently the stops 9 are then swung to a tangential position and caused to rotate in a trailing fashion with actuating disc 27. When the actuating discs 27 have performed an almost complete revolution, the stop fingers 9 swing up in the apertures 24' so that they can act as stops fcr the paper sheets of a new set to be collected in the accumulator.

Further reference to FIG. 2 will disclose that the paper sheets are removed by means of a conveyor roller 25 which has an apex extending through another aperture 24'' of the end bar 24. Conveyor roller 25 cooperates with a backing roller 26. Both rollers 26 and 25 are synchronously driven by drive means (not shown). The backing roller 26 is formed with a recess 26*a* in its periphery so that the conveyor roller 25 will contact the backing roller 26 only during a part of the revolution of backing roller 26 when the stops 9 have been retracted below the level of the end bar 24.

Figure 4:
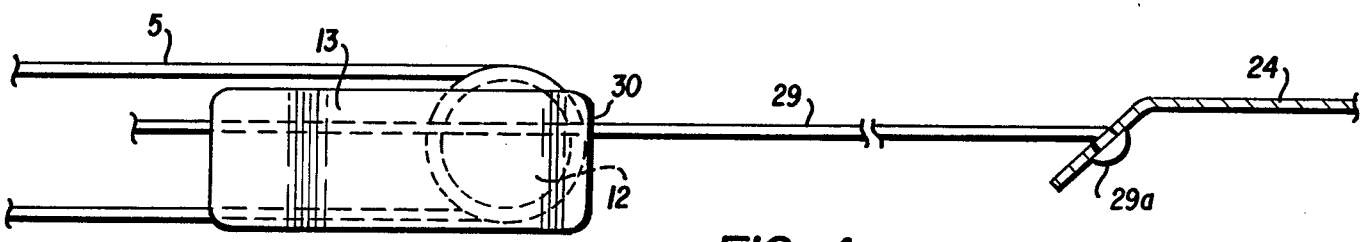
FIG. 4 is a fragmentary elevation showing in section the carriage on which are mounted the guide rollers for the conveyor belts and illustrates the cooperation of said carriage and rollers with supporting means of the receiving area comprised of rods secured to an end bar and extending through openings of the carriage.

FIG. 4 shows another embodiment of the horizontal supporting means defining the receiving area. The supporting means comprise thin rods 29 which are disposed downstream of the end bar 24 in the direction of conveyance and are secured to the end bar 24, for example, by being soldered, riveted, or screwed to the bar by fastening means generally indicated by 29*a*. The thin rods 29 extend through horizontal bores 30 of the carriage 13 so that carriage 13 can be displaced relative to the rods 29 when the accumulator is adjusted to a certain format. If rods 29 have a sufficient rigidity, they need not be supported at any other location other than the location generally indicated by the presence of the fastening means 29*a*.

FIGS. 1 to 3 show also a particularly desirable embodiment of the guide rollers 12 supporting the upper surface 5 of the belt 4. The guide rollers 12 are provided with extensions 35 (see particularly FIG. 3) which are smaller in diameter and which carry radially protruding bristle tufts 36. The bristle tufts 36 protrude radially above the surface of the conveyor belt 4 and are adapted to engage the trailing edge of each sheet and urge the edge of the paper sheet down to the level of the supporting strips 8, as shown most clearly in FIG. 3. As a result, the trailing edge of the paper sheets being conveyed into the accumulator descend quickly to the level of the supporting means 8 so that no sheet which is being received can be interleaved between two previously received sheets of the same set.

While the invention has thus been particularly shown and described with reference to preferred embodiments thereof, it will be understood by those skilled in the art that the foregoing and other changes in form and details may be made therein without departing from the spirit and scope of the invention.

The embodiments of the invention in which an exclusive property or privilege is claimed are defined as follows:

1. In an adjustable accumulator for accumulating paper sheets, including a plurality of movable carriages and a plurality of supporting rollers and at least one conveyor belt, at least one of the supporting rollers of which is rotatably mounted on a first movable carriage, said first carriage movable in a direction that is parallel to the direction of conveyance of said paper sheets so that the distance between said first carriage and a stop is variable, the improvement comprising:

at least one additional supporting roller supporting said conveyor belt mounted rotatably on a second movable carriage, said first and second movable carriages being adapted to move in parallel, but opposite directions; and, means interconnecting said first and second carriages so that, when said first carriage moves in a way to shorten the distance between said stop and said first carriage, said second carriage moves in a direction parallel, but opposite to, the direction of motion of said first carriage.

2. Apparatus according to claim 1 in which said interconnecting means comprise wire ropes.

3. Apparatus according to claim 1 wherein said interconnecting means comprise a toothed belt.

4. Apparatus according to claim 1 wherein said additional roller is spring-mounted on said second movable carriage.

5. Apparatus according to claim 1 further comprising paper support means located between said stop and said first movable carriage.

6. Apparatus according to claim 5 in which said support means are comprised of a row of parallel strips of material.

7. Apparatus according to claim 6 in which said material is plastic.

8. Apparatus according to claim 6 in which said strips are comprised of metal wires.

9. Apparatus according to claim 1 in which said stop further comprises an end bar having apertures therein through which at least two, a first and a second, opposed rollers may cooperate to engage said paper sheets.

10. Apparatus according to claim 9 in which one drive roller has mounted eccentrically thereon a pivotable, spring-mounted, stop lever.

11. Apparatus according to claim 9 in which said second roller has a circumference so that it cooperates with said first roller only for a part of their rotation.

12. Apparatus according to claim 1, further comprising support means located between said first carriage and said stop, said support means comprising thin rods passing through said first carriage.

13. Apparatus according to claim 5, further including a guide rod affixed to said first carriage and extending transversely thereto on the side of the receiving area, and a fixed anchoring point, whereby said guide rod functions to maintain the relationship between said support means which are slidingly supported and deflected by said guide rod and said fixed anchoring point to which said support means are fastened with their ends remote from the fastening point at the top.

14. Apparatus according to claim 13, in which said support means are anchored to said fixed anchoring point by way of a spring.

15. Apparatus according to claim 1, further including radially protruding bristle tufts mounted on extension of said supporting rollers.

* * * * *